United States Patent [19]

Barteaux

[11] Patent Number: 4,998,694

[45] Date of Patent: Mar. 12, 1991

[54] BAG HOLDER

[76] Inventor: Peter C. Barteaux, 803 - 1127 Barclay Street, Vancouver, B.C. V6E 4C6, Canada

[21] Appl. No.: 433,840

[22] Filed: Nov. 9, 1989

[51] Int. Cl.[5] ..... B65B 67/04

[52] U.S. Cl. ..... 248/100

[58] Field of Search ..... 248/100, 95, 97, 99, 248/101, 200; 211/88; 220/404; 141/314, 391; 312/321.5

[56] References Cited

U.S. PATENT DOCUMENTS

| | | | |
|---|---|---|---|
| 857,820 | 6/1907 | Mosher | 248/99 |
| 1,266,522 | 5/1918 | Oldham | 141/314 X |
| 2,305,863 | 12/1942 | Ginter | 248/100 |
| 3,162,414 | 12/1964 | Maschek . | |
| 3,986,649 | 10/1976 | Heimstra | 211/88 X |
| 4,174,085 | 11/1979 | Ferreira et al. . | |
| 4,398,689 | 8/1983 | Prader . | |
| 4,458,867 | 7/1984 | Malik . | |
| 4,579,307 | 4/1986 | Malik . | |
| 4,863,125 | 9/1989 | Bateman | 248/100 X |

FOREIGN PATENT DOCUMENTS

| | | | |
|---|---|---|---|
| 0641624 | 5/1962 | Canada | 248/100 |

*Primary Examiner*—Ramon O. Ramirez
*Attorney, Agent, or Firm*—Barrigar & Oyen

[57] ABSTRACT

A bag holder for supporting a conventional plastic grocery bag in an open position for use as a waste receptacle. The bag holder includes a support frame and a pair of collapsible swing arms connectible on opposed ends of the support frame. Adjustable and lockable mounting brackets are provided for removably mounting the support frame on a support surface, such as a drawer or cabinet underneath a kitchen countertop.

21 Claims, 5 Drawing Sheets

BAG HOLDER

FIELD OF THE INVENTION

This invention relates to an apparatus for supporting a plastic grocery bag in an open position for use as a waste receptacle. More particularly, this invention pertains to a portable, collapsible, bag holder which is positionable on a drawer or cabinet underneath a kitchen countertop and the like.

BACKGROUND OF THE INVENTION

Several bag holding devices have been disclosed in the prior art for supporting a grocery bag in an open position. Typically, such devices are designed for use in grocery store check-out areas to assist clerks in rapidly loading food stuffs or other merchandise into an open bag. For example, U.S. Pat. No. 4,398,689 granted to Prader on Aug. 16, 1983 discloses an apparatus for loading bags which is attachable to a check-out counter in a grocery store. The Prader device includes swingable handle arms secured to a rigid support frame. The handles of a conventional grocery bag can be attached to respective handle arms to maintain the bag in an open posture.

U.S. Pat. No. 4,579,307 granted to Malik on Apr. 1, 1986 discloses a wire rack which is adapted to hold a plastic bag open by its integral handle loops. The device includes a wall-mountable frame and a pair of spaced swing panels which can be locked in a bag loading position extending perpendicular to the frame. If desired, the rack can be collapsed by folding the swing panels inwardly.

The above-noted prior art references are distinguishable from the present invention in several respects. Both the Prader and Malik devices are structurally designed to retain a compliment of grocery bags which can be peeled away from a heat-welded stack and individually loaded in rapid succession. The present invention, by contrast, is adapted to support a single grocery bag in an open position for use as a waste receptacle.

Unlike the Prader and Malik devices, which are usually secured to a grocery check-out counter in a permanent fashion as discussed above, the present invention is intended to be fully portable. In particular, the present invention is removably mountable on a drawer or cabinet located immediately underneath a kitchen countertop.

U.S. Pat. No. 3,162,414 granted to Maschek on Dec. 22, 1964 does disclose a bag holding device mountable on the front wall of a drawer of a kitchen cabinet. However, this device is adapted to support paper grocery bags rather than plastic bags having integral handles. Moreover, the Maschek device is not designed to accommodate cabinet drawers and the like of a varying thickness as is the present invention.

The present invention overcomes the structural and functional shortcomings apparent in prior art bag holders in a simple, reliable and economic manner.

SUMMARY OF THE INVENTION

In accordance with the invention there is provided a bag holder having a support frame with a first side and a second side, adjustable mounting brackets connectable to the support frame for removably mounting the first side of the support frame on a support surface, and a pair of swing arms pivotably connectable on opposed ends of the support frame. The swing arms are moveable between a collapsed position whereat they lie in a plane approximately parallel to the second side of the support frame and an operative position whereat they extend in a plane approximately perpendicular to the second side of the support frame.

The mounting brackets of the present invention are preferably adjustable between a retracted position and a plurality of extended positions. More particularly, the mounting brackets are pivotably and slidably adjustable to conform to support surfaces of different widths.

A pair of locking wedges may also be provided for releasibly locking the mounting brackets in any one of a plurality of extended positions. Each locking wedge preferably has a tapered surface having a plurality of spaced-apart notches which are selectively engageable with a raised portion on the corresponding mounting bracket.

The swing arms may be biased toward their collapsed position or their extended, operative position. Preferably the swing arms include retention posts and slots for retaining the integral handle loops of a conventional plastic grocery bag.

BRIEF DESCRIPTION OF THE DRAWINGS

In drawings which illustrate a specific embodiment of the invention, but which should not be construed as restricting the spirit or scope of the invention in any way.

DETAILED DESCRIPTION OF THE PREFERRED EMBODIMENT

Figure 1:
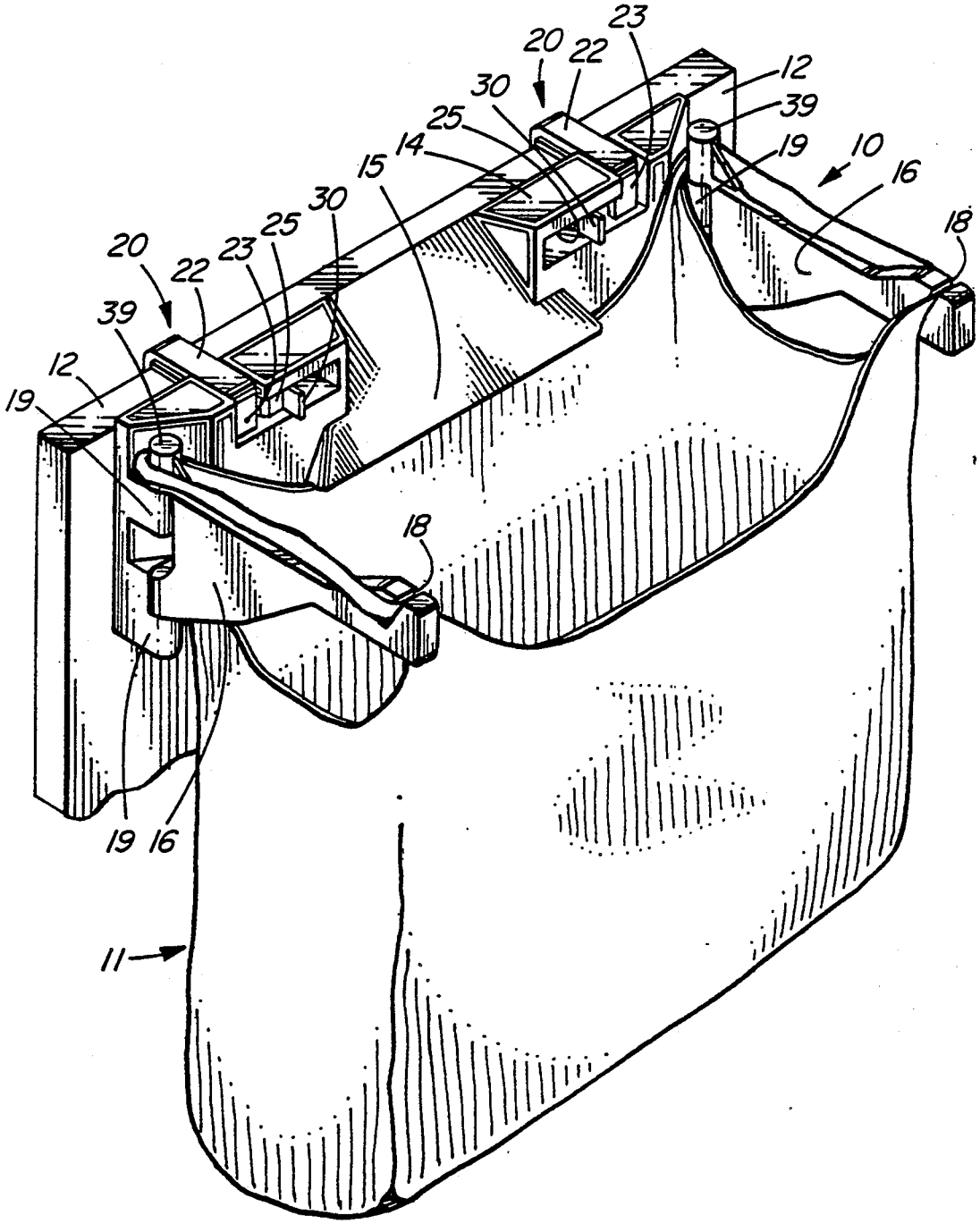
FIG. 1 is an isometric view of the bag holder mounted on a support surface in its operative position with a conventional plastic grocery bag attached.

With reference to FIG. 1, the present invention is directed to a bag holder 10 for supporting a conventional plastic grocery bag 11 in an open position for use as a waste receptacle. Bag holder 10 is removably mountable on a support surface 12, such as a drawer or cabinet underneath a kitchen countertop.

Figure 5:
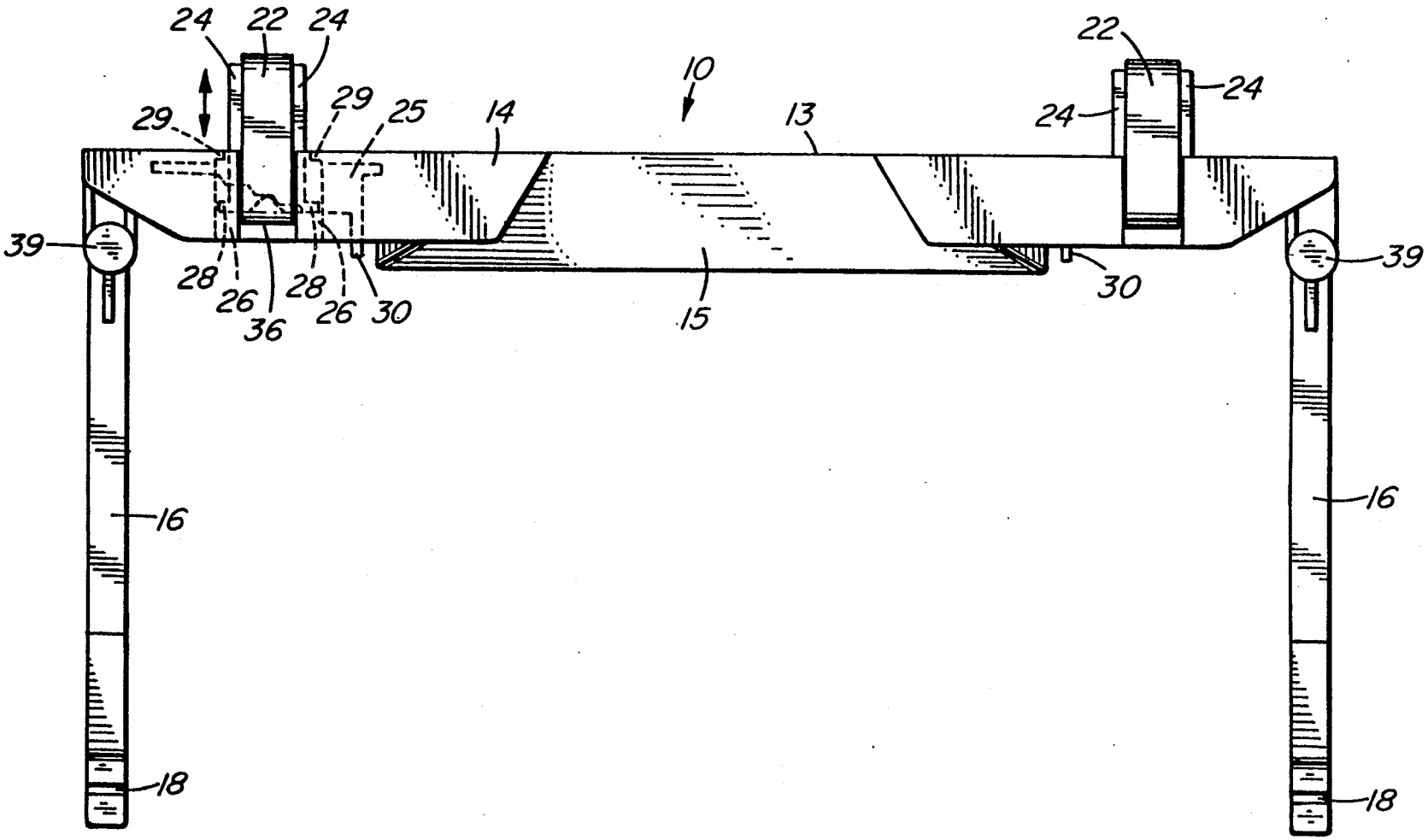
FIG. 5 is a top, plan view of the bag holder of FIG. 1 in its operative position.
Figure 6:
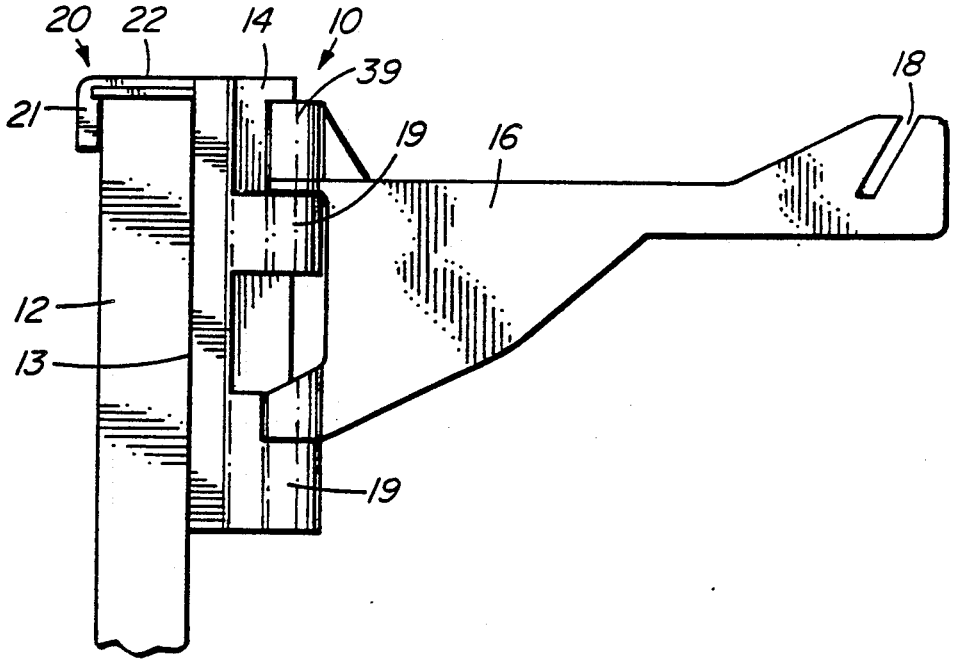
FIG. 6 is a side elevation of the bag holder of FIG. 1 in its operative position.

Bag holder 10 has a support frame 14 having a rear wall 13 (best shown in FIGS. 5 and 6). Support frame 14 also includes a forwardly and downwardly inclined deflection plate 15 for use in deflecting refuse into bag 11 as discussed in further detail below.

Figure 3:
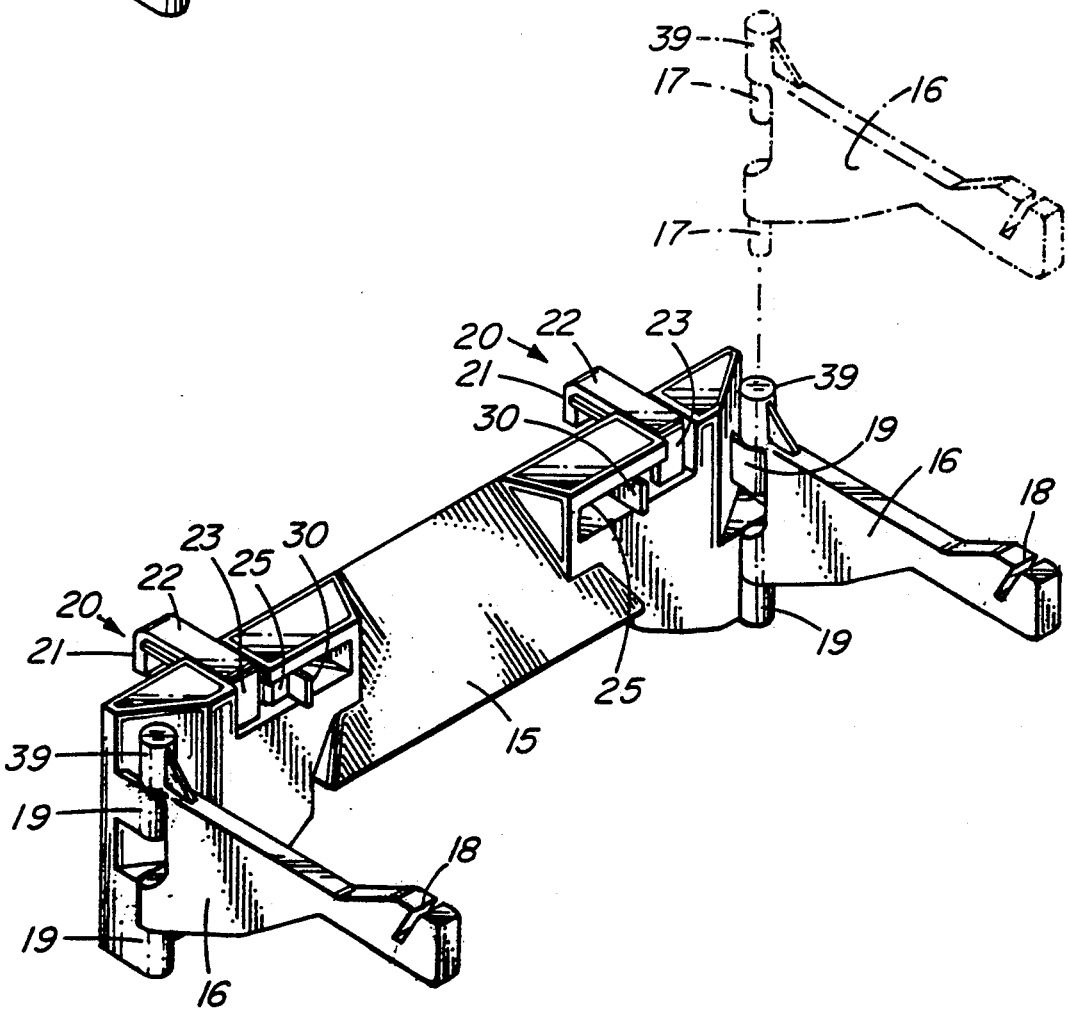
FIG. 3 is an isometric view of the bag holder of FIG. 1 in its operative position with the grocery bag removed for clarity of illustration showing one swing arm removed from the support frame in phantom outline.
Figure 4:
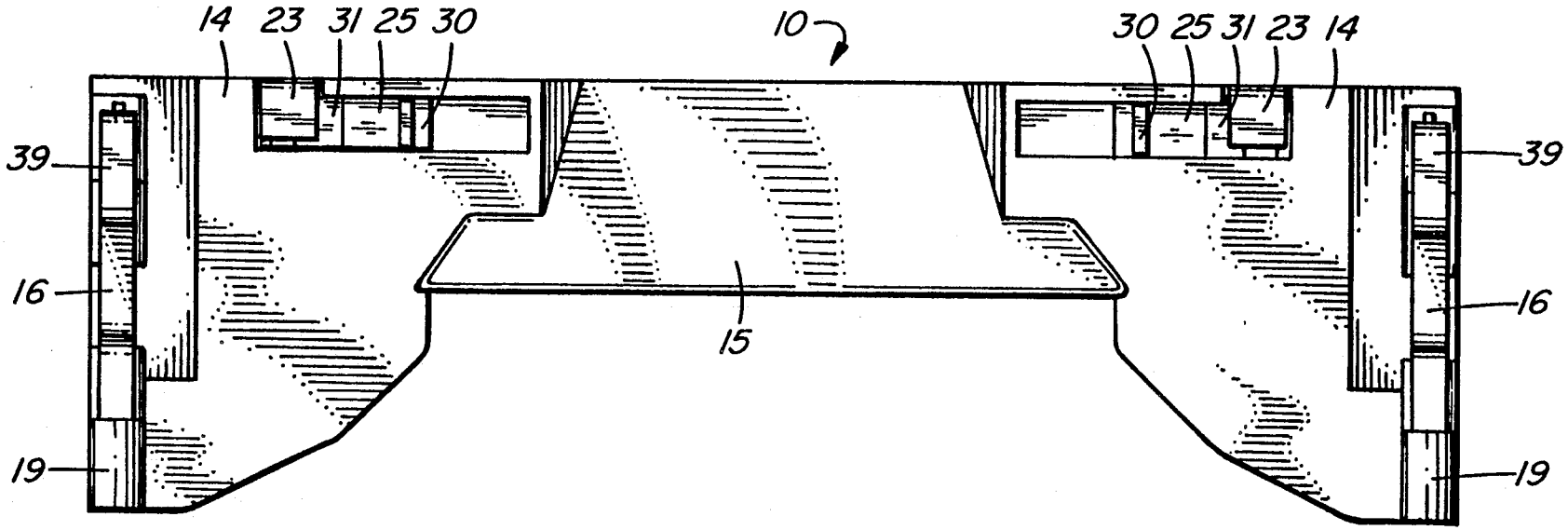
FIG. 4 is a front elevation of the bag holder of FIG. 1 in its operative position.

A pair of swing arms 16 is removably connected on opposed ends of support frame 14 as shown best in FIG. 3. Preferably swing arms 16 have vertical pins 17 (shown in phantom outline in FIG. 3) which slidably fit into mating sleeves 19 located on either end of support frame 14. Swing arms 16 are identical in construction and are readily interchangeable.

Figure 2:
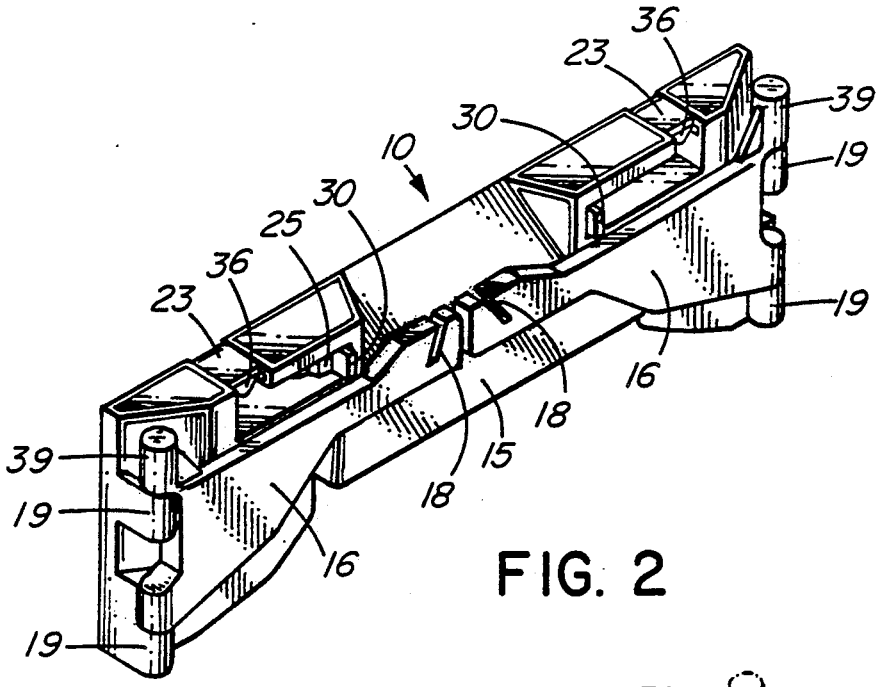
FIG. 2 is an isometric view of the bag holder of FIG. 1 in its collapsed position with the grocery bag removed for clarity of illustration.

Swing arms 16 are manually pivotable between an operative position in which they extend approximately perpendicular to support frame 14 (as shown in FIGS. 1 and 3–6) and a collapsed position in which they lie approximately parallel to and against support frame 14 (as shown in FIG. 2).

Each swing arm 16 has "retention means"; namely, slots 18 and retention posts 39 for releasibly retaining the integral handle loops of bag 11. Alternatively, the retention means may comprise a pair of slots, a pair of posts, or a combination of slots and posts for retaining respective ends of the handle loops of bag 11 so that bag 11 is securely maintained in an open posture when swing arms 16 are disposed in their extended operative position shown in FIG. 1. Optionally, retention posts 39 may be angled rearwardly to prevent the integral handle loops from inadvertently detaching from retention posts 39 when bag 11 is filled with refuse.

Bag holder 10 may also include "biasing means" (not shown) for urging swing arms 16 toward either their extended operative position or their collapsed position. For example, the biasing means may include a pair of coiled springs positionable on either end of support frame 14 which cooperate with swing arms 16. Alternatively, the biasing means may comprise hinge or interference points fabricated in support frame 14 and swing arms 16 during the plastic molding process.

Bag holder 10 further includes "mounting means"; namely, mounting brackets 20 for mounting support frame 14 on support surface 12. As shown in FIG. 3, each mounting bracket 20 is generally U-shaped and comprises a first portion 21, a second portion 22 and a third portion 23. Mounting brackets 20 are pivotable between a retracted position wherein second portion 22 extends downwardly flush with the rear wall 13 of support frame 14 and an extended position wherein second portion 22 extends rearwardly in a plane perpendicular to support frame 14. First portion 21 of each bracket 20 preferably has a raised tab or latch which snaps into a mating socket in support frame 14 to releasibly maintain mounting bracket 20 in its retracted position.

As shown in FIG. 6, when each mounting bracket 20 is disposed in its extended position, first portion 21 is positionable against the planar surface of support surface 12 (such as the inner, vertical panel of a kitchen drawer or cabinet), and second portion 22 supports bag holder 10 on an adjacent horizontal edge of the support surface 12 (such as the top edge of a kitchen drawer or cabinet).

As shown in FIG. 5, when each mounting bracket 20 is deployed in its extended position it is slidably adjustable along the longitudinal axis of second portion 22 to conform to the width of the particular support surface in question. More particularly, second portion 22 has laterally projecting rails 24 which are adapted to slide in mating slots 26 located in support frame 14. Mounting brackets 20 can be removably detached from support frame 14 by sliding brackets 20 forwardly until rails 24 are completely disengaged from slots 26.

Each mounting bracket 20 also preferably includes a pivot pin 28 (best seen in FIGS. 5 and 7) which projects laterally from second portion 22 at its point of attachment to third portion 23. As shown in FIG. 5, when second portion 22 is slid rearwardly to a fully extended position, pivot pin 28 bears against opposed flanges 29 located at the rear end of slot 26. This prevent mounting brackets 20 from inadvertently detaching from support frame 14 when mounting brackets 20 are disposed in their operative, extended position.

When second portion 22 of mounting bracket 20 is slid rearwardly to its fully extended position as discussed above, mounting bracket 20 is pivotable about the axis of pivot pin 28. This enables adjustment of each mounting bracket 20 between its extended position and its retracted position. If second portion 22 is not fully extended as discussed aforesaid, pivoting movement of mounting bracket 20 is prevented since rail 24 cannot be rotated out of engagement with its mating slot 26.

As discussed above, each mounting bracket 20 is slidable along the longitudinal axis of second portion 22 to conform to the width of the support surface 12 in question. This ensures that the rear wall 13 of support bracket 14 is positioned directly against the planar surface of support surface 12 when bag holder 10 is deployed in the operative position shown in FIG. 6 The rear wall 13 of support frame 14 preferably has a non-skid surface to frictionally engage support surface 12.

Figure 7:
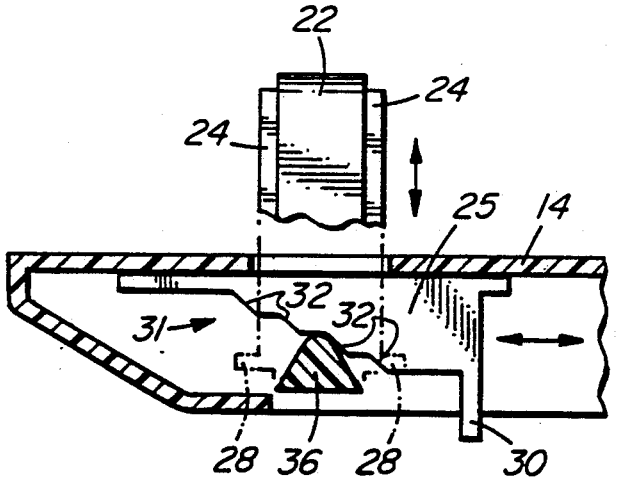
FIG. 7 is an enlarged, sectional view of the locking mechanism of the present invention.

Most kitchen drawers and cabinets are approximately ½ inch to 1 inch in width. Accordingly, mounting brackets 20 are primarily designed for adjustment within this range. As best shown in FIGS. 5 and 7, locking wedges 25 are provided for releasibly locking mounting brackets 20 in one of a plurality of extended positions. Locking wedges 25 are slidably adjustable relative to the rear wall 13 of support frame 14 by means of thumb tabs 30. Each locking wedge 25 has a tapered surface 31 having regularly spaced notches 32. As shown in FIG. 7, notches 32 are adapted to lockably engage a raised ridge 36 integral with third portion 23 of mounting bracket 20.

As a result of the "stepped" configuration of tapered surface 31, forced outward movement of locking wedges 25 causes mounting brackets 20 to slide forwardly along the longitudinal axis of second portion 22 as raised ridge 36 engages successive notches 32.

Thus, mounting brackets 20 can be releasibly locked in the desired extended position by manipulating locking wedges 25 using thumb tabs 30. Once the appropriate notch setting is selected, bag holder 10 is securely anchored on support surface 12. Forward movement of mounting brackets 20 is prevented by first portion 21 bearing against the planar surface of support surface 12; rearward movement of support brackets 20 is prevented by third portion 23 bearing against the tapered surface 31 of locking wedge 25.

Bag holder 10 is preferably made of flexible plastic. Since bag holder 10 has only four separate parts (i.e. support frame 14, swing arms 16, mounting brackets 20 and locking wedges 25), it can be economically manufactured using conventional injection molding technology.

In use, bag holder 10 is mountable on any suitable support surface 12, such as the upper edge of a kitchen drawer or cabinet. The user first pivots mounting brackets 20 upwardly from their retracted position to their extended position. In particular, the user pivots each mounting bracket 20 upwardly about the axis of pivot pin 28 until second portion 22 extends rearwardly in a plane perpendicular to support frame 14. Mounting brackets 20 can then be slid forwardly along the longitudinal axis of second portion 22. As discussed above, this is accomplished by sliding rails 24 within mating slots 26 located in support frame 14.

In order to facilitate mounting of bag holder 10 on a drawer or cabinet, the drawer or cabinet must be pulled outwardly a short distance. The user then places mounting brackets 20 on the top edge of the drawer or cabinet. Mounting brackets 20 are adjustable to conform to the width of the support surface in question by manually sliding locking wedges 25 outwardly using thumb tabs 30. As a locking wedge 25 is forced outwardly, the raised ridge 36 of third portion 23 of each corresponding mounting bracket 20 successively engages notches 32 of tapered surface 31, thereby causing mounting bracket 20 to slide forwardly. As shown in FIG. 6, once the appropriate notch setting is arrived at, mounting bracket 20 is releasibly locked in its extended position with the first portion 21 of mounting bracket 20 securely engaging the inner, planar surface of the kitchen drawer or cabinet and the rear wall 13 of support frame 14 engaging the outer planar surface of the drawer or cabinet.

Rear wall 13 of support surface 14 preferably has a non-skid covering to frictionally engage the support surface 12 in question. In one configuration, each mounting bracket 20 may be spring-loaded to ensure that first portion 21 securely engages support surface 12.

Once support frame 14 is securely mounted on support surface 12, the user then manually pivots swing arms 16 outwardly from their collapsed position to their extended operative position. In the preferred embodiment, when swing arms 16 are rotated beyond an angle of roughly 45°, the biasing means discussed aforesaid urges swing arms 16 to their extended operative position.

The user may then attach the integral handle loops of a conventional plastic grocery bag 11 to respective swing arms 16. In particular, one end of each handle loop is wrapped around retention post 39 and the opposite end of the handle loop is fitted into slot 18 located on the opposite end of each swing arm 16. Bag 11 is thereby disposed in an open position between opposed swing arms 16 as shown in FIG. 1. The rearward edge of bag 11 may be tucked underneath the lower edge of deflection plate 15 to assist in maintaining bag 11 in an open position.

After bag 11 is suitably secured to bag holder 10, the kitchen drawer or cabinet is typically pushed to its closed position so that bag holder 10 is positioned beneath the overhanging portion of the kitchen countertop with open bag 11 extending therebeyond. Typically there is a small gap in most kitchens between the top edge of the kitchen drawer and the overlying countertop. Accordingly, mounting brackets 20 will not usually obstruct substantial closure of the kitchen drawer.

To place refuse, such as food scraps, into bag 11 the user need only scrape or push the refuse along the countertop to the edge thereof where it will fall directly into open bag 11. Deflection plate 15 assists in deflecting refuse toward the centre of bag 11.

The design of bag holder 10 permits bag 11 to be positioned closer to the mounting surface than prior art devices; this reduces the chance that refuse will inadvertently spill between the countertop and the open bag 11.

Bag holder 10 is also designed with a narrow profile so that it will not obstruct use of the kitchen drawer handles or knobs. Furthermore, bag holder 10 does not usually restrict use of kitchen cabinets located directly beneath the drawer on which bag holder 10 is mounted.

Once bag 11 is suitably full of refuse, it can be detached from swing arms 16 and discarded. A replacement bag can then be installed in the manner described above.

In the interests of safety, swing arms 16 will pivot on a horizontal plane away from their extended operative position if bag holder 10 is inadvertently brushed by a user. In this event, the biasing means discussed aforesaid will preferably urge swing arms 16 back their operative position.

The present invention may be folded to its collapsed position without detaching grocery bag 11 from swing arms 16, provided that bag 11 is not overly full of refuse. The user need only manually pivot swing arms 16 inwardly. Thus bag holder 10 can be temporarily folded to its collapsed position without removing it from the support surface 12.

In its collapsed configuration, swing arms 16 are flush with support frame 14. Accordingly, there are no protruding parts likely to be caught on the user's clothing.

In order to fully collapse bag holder 10 for storage or transport, locking wedges 25 are slid inwardly to disengage the locking means and the device is lifted from the support surface 12. Mounting brackets 20 are then slid rearwardly to their fully extended position and then pivoted downwardly about the axis of pivot pin 28 to their retracted position flush with rear wall 13 of support frame 12. In the fully collapsed configuration shown in FIG. 2, the forward surface of swing arms 16 is flush with the forward edge of deflection plate 15. This enables a plurality of bag holders 10 to be readily stacked.

Support frame 14 preferably has apertures to enable bag holder 10 to be hung in a conventional manner on nails, screws or other suitable fasteners secured to the support surface, such as the inner panel of a kitchen cupboard. In this configuration mounting brackets 20 remain in their retracted position flush with the rear wall 13 of support frame 14; swing arms 16 may be stowed in their collapsed position or extended in their operative position as desired.

Since the present invention can be removably attached to a wide variety of mounting surfaces, it can be adapted for many analogous uses. For example, bag holder 10 is particularly useful on camping and boating trips and the like.

As will be apparent to those skilled in the art in the light of the foregoing disclosure, many alterations and modifications are possible in the practice of this invention without departing from the spirit or scope thereof. Accordingly, the scope of the invention is to be construed in accordance with the substance defined by the following claims.

I claim:

1. A bag holder comprising;

(a) a support frame having a first side and a second side;

(b) adjustable mounting means connectable to said support frame for removably mounting said first side of said support frame on a support surface, wherein said mounting means is movable between a plurality of mounting positions extending generally perpendicular to said support frame first side, and a retracted position substantially co-planar with said support frame first side; and (c) a pair of swing arms pivotally connectable on opposed ends of said support frame, wherein said swing arms are movable between a collapsed position whereat they lie in a plane approximately parallel to said second side of said support frame and an operative position whereat they extend in a plane approximately perpendicular to said second side of said support frame.

2. A bag holder as defined in claim 1, wherein said mounting means comprise a pair of interchangeable mounting brackets.

3. A bag holder as defined in claim 2, further comprising releasible locking means for locking said mounting brackets in any one of said plurality of extended mounting positions.

4. A bag holder as defined in claim 2, wherein each of said mounting brackets comprises:

(a) a first portion for frictionally engaging a planar side of said support surface;

(b) an elongated second portion integrally connected to one end of said first portion, for supporting said bag holder on an edge of said support surface disposed in a plane perpendicular to said planar side; and (c) a third portion integrally connected to said second portion opposite said first portion.

5. A bag holder as defined in claim 4, wherein said second portion is flush with a top edge of said support frame when said mounting bracket is in one of said extended mounting positions.

6. A bag holder as defined in claim 4, wherein said second portion further comprises sliding means for selectively sliding said second portion along its longitudinal axis when said mounting bracket is in an extended position.

7. A bag holder as defined in claim 6, wherein said sliding means comprises a rail extending along opposed, longitudinal edges of said second portion, and wherein said rail is slidable in a mating slot in said support frame.

8. A bag holder as defined in claim 4, further comprising releasible locking means for locking said mounting brackets in any one of said plurality of extended mounting positions and wherein said locking means is adapted to releasibly engage said third portion when said mounting bracket is deployed in an extended position.

9. A bag holder as defined in claim 8, wherein the inner surface of said third portion proximate to said first portion has a raised ridge.

10. A bag holder as defined in claim 9, wherein said locking means comprises a locking wedge relative to said first side of said support frame, said locking wedge having a plurality of spaced-apart notches which are selectively positionable in mating relationship with said raised ridge.

11. A bag holder as defined in claim 10, wherein said locking wedges are regularly tapered such that forced outward movement of said locking wedges when said mounting brackets are in an extended mounting position causes said second portion of said mounting bracket to slide forwardly.

12. A bag holder as defined in claim 4, wherein said second portion is flush with said first side of said support frame when said mounting bracket is in said retracted position.

13. A bag holder as defined in claim 4, wherein said third portion is flush with a top edge of said support frame when said mounting bracket is in said retracted position.

14. A bag holder as defined in claim 10 wherein said locking wedges further comprise tabs for manually sliding said locking wedges relative to said first side of said support frame.

15. A bag holder as defined in claim 1, wherein said swing arms further comprise retention means for retaining a conventional grocery bag having integral handle loops, thereby supporting said bag in an open posture between said swing arms when said swing arms are in said extended operative position.

16. A bag holder as defined in claim 15, wherein said swing arms are moveable between said extended operative position and said collapsed position when said bag handle loops are attached to said retention means.

17. A bag holder as defined in claim 16, wherein said swing arms are movable through an arc of 180 degrees.

18. A bag holder as defined in claim 1, wherein said swing arms are interchangeable.

19. A bag holder as defined in claim 1, further comprising a downwardly and forwardly inclined deflection plate integral with a top and said second side of said support frame, for deflecting refuse into the central aspect of said bag when said swing arms are in said extended operative position.

20. A bag holder as defined in claim 19, wherein said swing arms are flush with the forward edge of said deflection plate when said swing arms are in said collapsed position.

21. A plurality of bag holders as defined in claim 20 disposed in a stacked array.

* * * * *